United States Patent [19]

Pedersen

[11] 4,182,151

[45] Jan. 8, 1980

[54] CLEARING OF RETAINED LIQUIDS FROM RECESSES IN THIN WALLED MEMBERS

[76] Inventor: Peter C. Pedersen, R.D. 2, Woods Rd., Lebanon, N.J. 08833

[21] Appl. No.: 839,893

[22] Filed: Oct. 6, 1977

[51] Int. Cl.[2] ..... B21D 28/30

[52] U.S. Cl. ..... 72/325; 30/446

[58] Field of Search ..... 220/354; 30/414, 446; 72/325

[56] References Cited

U.S. PATENT DOCUMENTS

| | | | |
|---|---|---|---|
| 580,916 | 4/1897 | Westerfield | 30/446 |
| 1,080,636 | 12/1913 | Johnson | 30/414 |
| 2,029,607 | 2/1936 | Brenner | 30/446 |
| 2,084,084 | 6/1937 | Greer | 220/354 |
| 2,709,022 | 5/1955 | Fatke | 220/354 |
| 2,784,488 | 3/1957 | Olson et al. | 30/446 |
| 2,885,108 | 5/1959 | Donoghue | 220/354 |
| 2,957,601 | 10/1960 | Novick | 30/446 |

FOREIGN PATENT DOCUMENTS

| | | | |
|---|---|---|---|
| 589683 | 6/1925 | France | 30/414 |

*Primary Examiner*—Lowell A. Larson
*Attorney, Agent, or Firm*—George E. Kersey

[57] ABSTRACT

Method and apparatus for the clearing of liquids retained in recesses, for example, in the lid holding groove at the rim of a paint can, by using a tool to perforate the base of the groove and allow the paint residue retained in the groove after pouring to drain into the can when it is uprighted.

11 Claims, 6 Drawing Figures

CLEARING OF RETAINED LIQUIDS FROM RECESSES IN THIN WALLED MEMBERS

BACKGROUND OF THE INVENTION

This invention relates to the clearance of trapped liquids, and more particularly, to the clearance of liquid residues from the rim recesses of paint cans.

Many containers must be resealable until their contents have been used. Thus the usual paint can has a reusable lid that interlocks with a recessed groove at the rim of the can. When paint is poured from the can and then uprighted, residual paint spreads into the groove.

If the paint residue is allowed to remain in the groove, it can harden and interfere with subsequent sealing of the can. While the paint residue can be cleared from the groove, this is a time consuming procedure and is wasteful of the paint.

Accordingly, it is an object of the invention to facilitate the clearance of trapped liquids. A related object is to facilitate the clearance of paint residues trapped in the lid sealing grooves of paint cans.

A further object of the invention is to promote the resealability of containers including those used for the storage of paint. A related object is to prevent liquid residues from interfering with the resealing operation.

Another object is to avoid the need for clearing the rim and other recesses of containers, particularly those used in transferring liquids to other containers. A related object is to avoid the need for clearing the grooved recess at the rim of a can used in the transfer of paint to another container.

A further object of the invention is to curtail the wastage of trapped liquids. A related object is to curtail the wastage of paint that becomes trapped in a rim groove of a resealable container when paint is poured from the container.

SUMMARY OF THE INVENTION

In accomplishing the foregoing and related objects, the invention provides for clearing materials retained in recesses in thin walled members by a tool with teeth for producing a plurality of perforations in each recess to permit the outflow of any otherwise retained material. The tool is operated by being positioned in the recess, with pressure applied to bring about the desired perforations.

In accordance with one aspect of the invention, the recess is continuous and a plurality of the perforations are made simultaneously.

In accordance with another aspect of the invention, the perforations are regularly spaced and the tool is formed by a toothed member. In accordance with a particular aspect of the invention, the toothed member is a cylindrical band with a plurality of teeth along one edge.

In accordance with a further aspect of the invention, the tool is used to multiply perforate the recessed lid retaining groove in a paint can. This allows paint that would otherwise be retained in the recess, as a result of pouring paint from the can, to drain into the interior of the can through the perforations. The perforations are located at the bottom of the lid retaining groove so as not to interfere with subsequent closure of the can by the lid. This eliminates any need for wipping the groove to assure subsequent sealing of the lid and saves the paint that would be wasted in the wiping operation. Once the groove of a paint can has been perforated in accordance with the invention, the can may be used repeatedly without any further modification.

In accordance with another aspect of the invention, the groove can be preperforated to avoid the need for perforation at the time of usage of the associated container.

DESCRIPTION OF THE DRAWINGS

Other aspects of the invention will become apparent after considering several illustrative embodiments taken in conjunction with the drawings in which.

DETAILED DESCRIPTION

Figure 1:
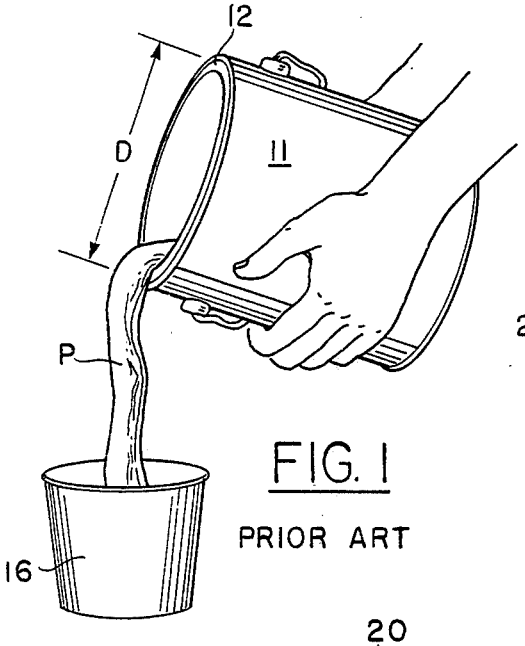
FIG. 1 PRIOR ART
FIG. 1 is a perspective view showing paint being poured into a pail from a standard container in accordance with customary practice.

Turning to the drawings, FIG. 1 illustrates the usual procedure for transferring contents from a resealable storage container 11 to a temporary storage pail 16. This particular container 11 is a paint can containing paint P.

In preparation for the transfer, a lid (not shown) is pried away from a recessed groove 12 at the lip of the container 11. The container 11 is then tilted in the manner indicated and the contents, for example, paint P, is poured into the pail 16.

When the container 11 is righted, residual paint P at the rim spreads into the groove 12. Unless the paint residue is removed from the groove 12, it can interfere with subsequent attempts to reseal the container.

Figure 2:
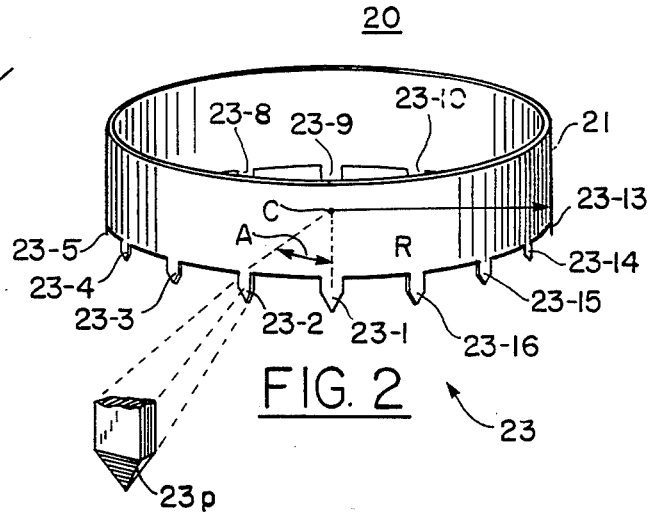
FIG. 2 is a perspective view of a tool in accordance with the invention for use in clearing residual paint from the lid retaining groove of the can in FIG. 1.

To facilitate the automatic clearance of the paint residue from the groove 12, the invention makes use of a tool 20 shown in FIG. 2. The tool 20 includes a structural member 21 with a set of teeth 23. The particular structure 21 is a cylindrical band with a mean diameter approximating the mean diameter D of the recessed groove 12 of the can 11 shown in FIG. 1. The radius R of the band 21, with respect to the center C, is less than the maximum groove radius. As indicated in FIG. 2 the tool 20 has 16 uniformly spaced teeth 23-1 through 23-16 positioned on the lower peripheral edge of the band 21 in four quadrants 23-1 through 23-5, 23-5 through 23-9, 23-9 through 23-13 and 23-13 through 23-1. Accordingly, the arc between adjoining teeth extends over an angle A of 22.5°. In addition the successive teeth of each quadrant have successively changing heights, e.g., the teeth 23-1 through 23-5 of the first quadrant have successively decreasing heights, with the first tooth 23-1 having a maximum height and the successive teeth 23-2, 23-3, 23-4 and 23-5 being progressively shorter and incrementally shorter. This order is reversed in the second and fourth quadrants; while the third quadrant is like the first.

In an illustrative embodiment of the invention, the band 21 of the tool 20 was formed from 14-gauge stainless steel with a radius of 2 29/32" and a height for the first tooth 23-1 of 10/32". The successive teeth 23-2 through 23-5 were progressively reduced in height by 1/32", with the tooth 23-2 having a height of 9/32", the tooth 23-3 a height of 8/32", the tooth 23-4 a height of 7/32", and the tooth 23-5 a height of 6/32". Each tooth had a width of 5/32" and the pyramital portion 23*p* of each tooth has a height of 4/32". The shoulder between the base of the pyramid and the rim of the band 21 therefore became 6/32" for the first tooth 23-1 and was progressively reduced by 1/32" for each succeeding tooth, so that the second tooth 32-2 had a shoulder of 5/32". As noted above, the teeth of each quadrant are reversed and repeated in the next quadrant. Thus the tooth 23-9 corresponds to the tooth 23-1 while the tooth 23-8 corresponds to the tooth 23-2. Similarly, in the third quadrant, the tooth 23-10 corresponds to the tooth 23-2 while in the fourth quadrant it is the tooth 23-16 that corresponds to the tooth 23-2. The pyramidial point 23-*p* shown exploded away from the tooth structure 23-2 in FIG. 2 is particularly effective in providing the desired perforations in the base of the grooved recess 12 of FIG. 1.

Figure 3A:
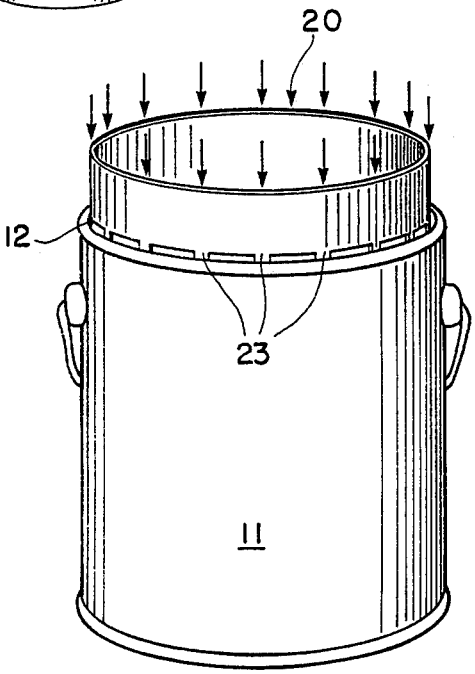
FIG. 3A is a perspective view illustrating the tool of FIG. 2 being used to perforate the lid retaining groove of the can in FIG. 1 in accordance with the invention.

The use of the tool 20 with the can 11 is illustrated in FIG. 3A. The tool 20 is placed above the opened container 11 with the teeth 23 in the groove 12. Pressure is then applied in any convenient fashion, for example, by hand, in the direction indicated by the arrows along the upper edge of the tool 20. This causes initial penetration of the base of the groove 12 by the oppositely positioned and longest teeth 23-1 and 23-9 of FIG. 2. The penetration initiated by the teeth 23-1 and 23-9 continues until pairs of teeth 23-2 and 23-16 adjoining the tooth 23-1, and 23-8 and 23-10 adjoining the tooth 23-9, come into contact with the base of the groove 12. The further application of pressure brings the next sets of teeth into contact with the base until the lower rim of the collar 21 is flush with the base surface of the groove 12. Thus there is initial simultaneous perforation of the groove 12 by the teeth 23-1 and 23-9, followed by simultaneous perforation by four teeth 23-2, 23-16, 23-10 and 23-8, followed by other simultaneous perforations until the entire groove 12 is perforated as shown in FIG. 3B.

Figure 3B:
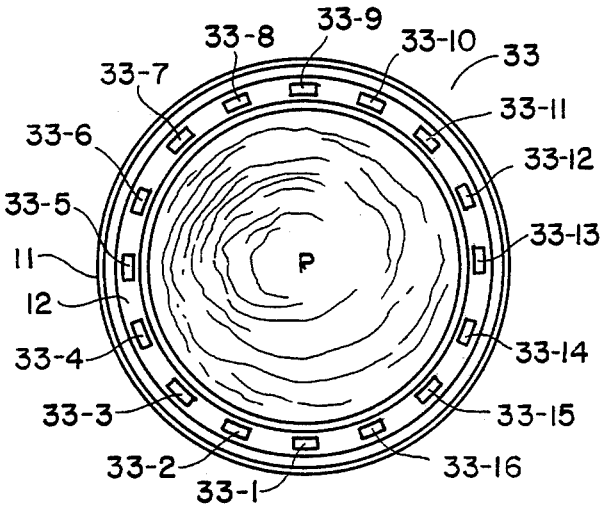
FIG. 3B is a top view of the can of FIG. 3A after perforations have been formed in accordance with FIG. 2.

As indicated in FIG. 3B, when the application of pressure is completed and the tool 20 is removed from the can 11, the groove 12 is provided with a set of perforations 33-1 through 33-16, corresponding to the teeth 23-1 through 23-16 of FIG. 2. It is to be noted that the perforations 33 are of equal configuration and uniformly spaced. The presence of the perforations 33 permits any residual paint in the groove 12 to drain into the interior of the container 11, thus clearing the groove and preventing the formation of a hardened film of paint which could interfere with subsequent attempts to reseal the container 11 with its removed lid.

It is to be noted that the formation of the drain apertures 33 at the base of the groove 12 does not interfere with the subsequent sealing of the can 11 by replacement of its lid. In addition the invention can be used to pre-form drain apertures 33 for paint containers, so that the tool 20 need not be used at the job site. In any event, the groove 12 can be perforated at the factory where the containers are produced before being filled with paint P.

Figure 4A:
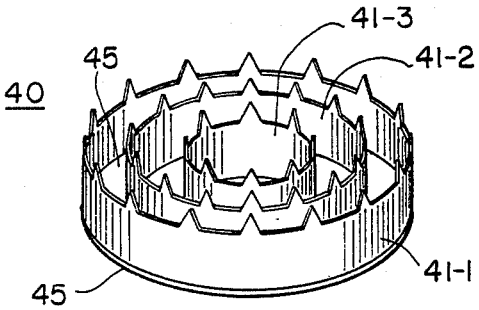
FIG. 4A is a multiple tool embodiment of the invention.
Figure 4B:
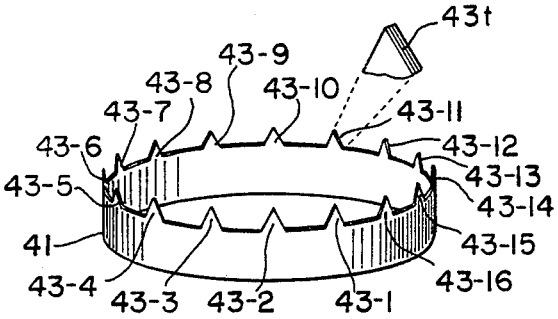
FIG. 4B is an alternative embodiment of the tool of FIG. 2.

A further embodiment of the invention is shown in FIG. 4B, with three individual punch rings 41-1, 41-2 and 41-3 mounted on a base 45 to allow the composite tool 40 to be used with containers of three different sizes. Thus the band 41-1 corresponds to the rim of a gallon container, while the band 41-2 corresponds to the rim of a half-gallon container, with the innermost rim 43-3 corresponding to the rim of a quart container.

Still another embodiment of the invention is shown in FIG. 4B for a single rim 41 in which the teeth 43-1 through 43-16 are of uniform height and have a triangular profile 43*t* as shown for the breakaway portion of the tooth 43-11. In the embodiment of FIG. 4B, placement of the band 41 with the teeth 43 in the groove of a container is followed by simultaneous piercing of the base of the groove by all the teeth since they are of equal height with respect to the associated edge of the rim 41. It has been found in practice that 16 teeth are particularly suitable for gallon containers with the numbers and sizes of the teeth being appropriately scaled for larger and smaller containers.

While various aspects of the invention have been set forth by the drawings and specifications, it is to be understood that the foregoing detailed description is for illustration only and that various changes in parts as well as the substitution of equivalent constituents for those shown and described may be made without departing from the spirit and scope of the invention as set forth in the appended claims.

What is claimed is:

1. A tool for preventing flowable material from becomming entrapped in the recessed circular rim of a container which comprises a circular band having the diameter of the recessed rim, and a plurality of triangular profile teeth on one edge of said band for forming apertures in said recessed rim successive ones of said teeth being of successively varying heights to facilitate the formation of said apertures in said recessed rim.

2. A tool as defined in claim 1 wherein said teeth are regularly spaced.

3. A tool as defined in claim 1 wherein said teeth are pyramidal.

4. A tool as defined in claim 1 wherein said teeth are proportioned to form parallelogram apertures in said recessed rim.

5. A tool as defined in claim 1 wherein said teeth have at least one side wall which is coincident with a side wall of said circular band.

6. A tool as defined in claim 1 wherein a plurality of circular bands with said teeth are nested within one another to accommodate containers with recesses of different diameters.

7. A tool as defined in claim 1 wherein said teeth are of successively decreasing heights.

8. A tool as defined in claim 1 wherein said band contains diametrically opposed teeth of maximum height.

9. A tool as defined in claim 7 wherein the teeth adjoining each diametrically opposite tooth are of reduced height.

10. A tool as defined in claim 8 wherein each tooth beyond each adjoining tooth is of lesser height than the adjoining tooth.

11. A tool as defined in claim 1 wherein said teeth are positioned in four quadrants with the successive teeth of each quadrant having successively decreasing heights which alternate in direction of decrease in alternate quadrants.

* * * * *